US005570075A

United States Patent [19]

Krimmer et al.

[11] Patent Number: 5,570,075

[45] Date of Patent: Oct. 29, 1996

[54] COIL FORMER WITH INJECTION-MOLDED ENCAPSULATION

[75] Inventors: Erwin Krimmer, Pluederhausen; Richard Lorenz, Marbach; Tilman Miehle, Kernen; Steffen Schumacher, Renningen, all of Germany

[73] Assignee: Robert Bosch GmbH, Stuttgart, Germany

[21] Appl. No.: 483,397

[22] Filed: Jun. 7, 1995

[30] Foreign Application Priority Data

May 8, 1994 [DE] Germany ..... 44 27 767.9

[51] Int. Cl.[6] ..... H01F 15/10; H01F 27/30

[52] U.S. Cl. ..... 336/96; 336/83; 336/192

[58] Field of Search ..... 336/83, 96, 192, 336/205, 198, 208, 107; 310/71

[56] References Cited

U.S. PATENT DOCUMENTS 3,328,736 6/1967 Keek ..... 336/192

4,890,085 12/1989 Saito ..... 336/192

5,132,655 7/1992 Suzuki et al. ..... 336/192

FOREIGN PATENT DOCUMENTS 9213889 3/1994 Germany .

*Primary Examiner*—Thomas J. Kozma

*Attorney, Agent, or Firm*—Michael J. Striker

[57] ABSTRACT

A coil former with injection-molded encapsulation has a top fitting in which coil wire guides for guiding a coil wire are formed. By virtue of the specific shape and arrangement of the coil wire guides, it is ensured, in particular together with a special design of the housing which surrounds the coil former, that the coil wire is only stressed in its longitudinal direction. As a result, damage or preliminary damage of the coil wire is prevented and reliability is increased.

4 Claims, 2 Drawing Sheets

COIL FORMER WITH INJECTION-MOLDED ENCAPSULATION

BACKGROUND OF THE INVENTION

The invention is based on a coil former with injection-molded encapsulation. In a known coil former of this kind, serving as a component of a speed-of-revolution sensor, a coil wire is guided in curved grooves formed on the surface of the foil former. The coil wire is wound around busbars arranged in the region of the ends of the grooves, and soldered thereto. The coil former and, in particular, the region of the grooves and of the busbars are encapsulated by injection molding with silicone in order to protect the coil wire and damp its vibrations. The coil former, with injection-molded encapsulation, manufactured in this way is enclosed by a pot-shaped metal housing which is connected to the coil former at its circumference, and sealed, by crimping.

It is disadvantageous here that when in particular the grooves are encapsulated by injection molding with a less elastic material than silicone, for example thermoplastic melt, the coil wire in the curved grooves is deflected and stressed transversely with respect to its longitudinal direction. This deflection leads to a shearing and bending stressing which is critical for the coil wire and can lead to a break or prestressing or preliminary damage of the coil wire. Furthermore, by directly winding around the relatively sharply edged busbars, it is possible for the coil wire to suffer preliminary damage even when only one tensile stress occurs.

SUMMARY OF THE INVENTION

Accordingly, it is an object of the present invention to provide a coil former which avoids the disadvantages of the prior art.

In keeping with these objects and with others which will become apparent hereinafter, one feature of the present invention resides, briefly stated, in a coil former with injection-molded encapsulation, with a coil core around which at least one layer of a coil wire is wound, a top fitting which is arranged above the coil core on a flange and has connection plugs which are connected to the coil wire in an electrically conductive way, with groove-shaped coil wire guides which are formed between the connection plugs and the coil core, the coil wire guides being formed in a linear way in the top fitting and running essentially perpendicular to the flange and in the axial direction of the coil core, and with a housing, surrounding the coil former made of plastic, wherein semicylindrical winding guides are assigned to the connection plugs and are arranged as extensions of the coil wire guides above the connection plugs.

In accordance with one modification the housing can have recesses to the side of the connection plugs. In accordance with another modification, the top fitting can project virtually as far as the external diameter of the housing.

When the coil former is designed in accordance with the present invention, it has, in contrast, the advantage that during the encapsulation of the grooves by injection molding only tensile stresses, and no shearing or bending stresses, act on the coil wire. As a result, the risk of the coil wire breaking or suffering preliminary damage is reduced. This tensile stress acts at the junction point with the wire connecting lugs with only a low stress concentration factor, as a result of which the risk of the wire suffering preliminary damage from the tensile stress is additionally decreased.

By virtue of a special design of the injection-molded encapsulation which simultaneously forms the housing, or alternatively of the upper area of the coil former, the plastic melt can be guided in a selective way during the manufacture of the injection-molded encapsulation of the coil former, and thus a particularly low stressing of the coil wire as a result of reduced thermal expansion both during the injection process and during operation is achieved.

In accordance with still another feature of the present invention, a method of making a coil former is proposed, in which a plastic melt which is used for encapsulating the coil former by injection molding and forms the housing is provided in the coil wire guide in such a way that the plastic melt fills the coil wire guides in their axial direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
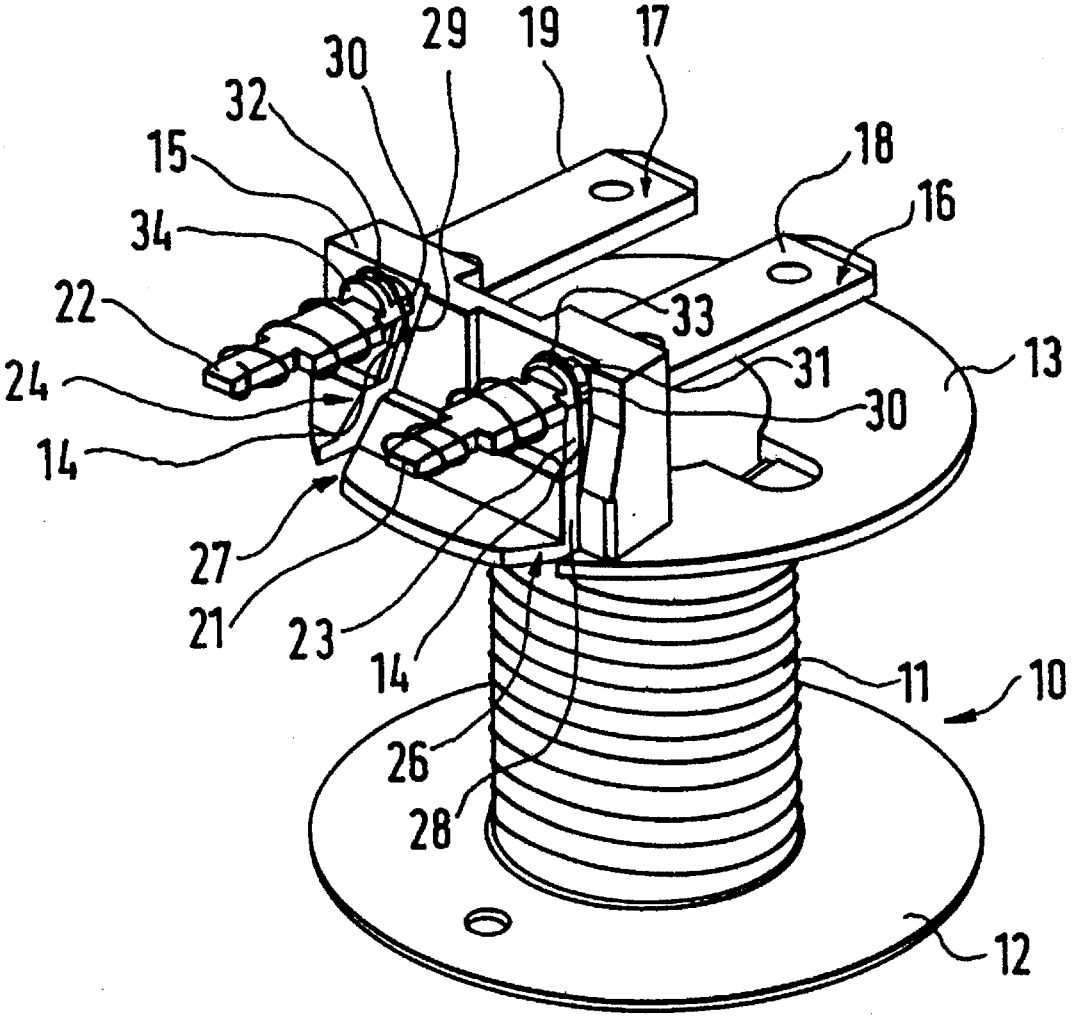
FIG. 1 shows a first coil former in a perspective view.
Figure 2:
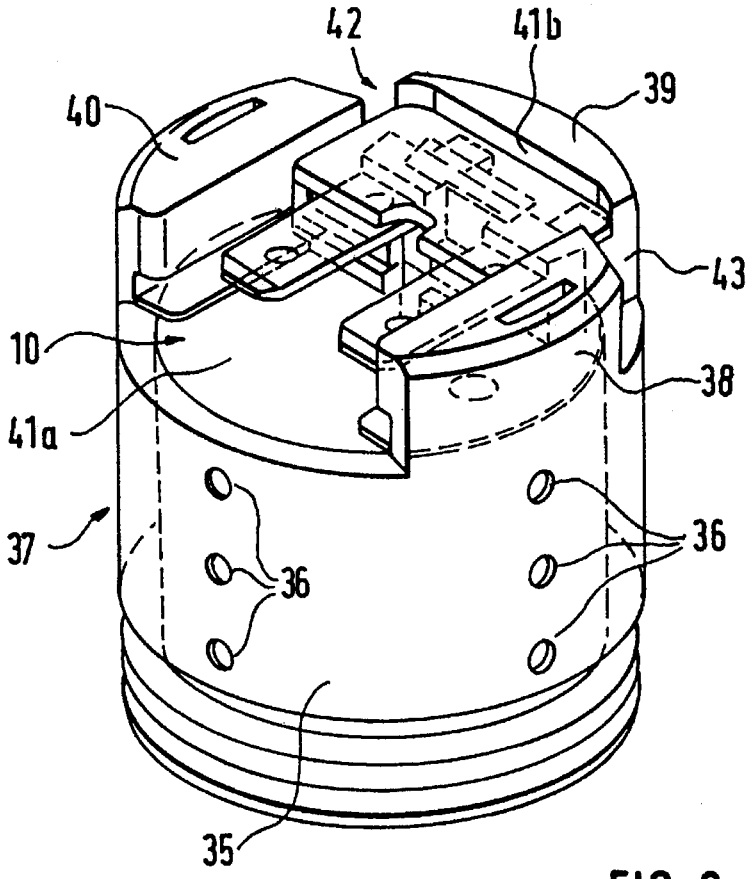
FIG. 2 shows a coil former with injection-molded encapsulation in a perspective view.

A coil former 10 which is for example a component of a solenoid valve (not illustrated), has a sheath-shaped coil core 11. In practice, for example a magnet core (also not illustrated here) with an armature is arranged inside the coil core 11. The coil core 11 is bounded by two essentially disk-shaped flanges 12, 13. The coil core 11 and flanges 12, 13 are manufactured integrally from plastic. On the coil core 11, an insulated coil wire 14 consisting preferably of copper is wound between the flanges 12, 13 in several layers, only one layer being illustrated in the drawing for the sake of simplicity. On the outer end side of one flange 13, a top fitting 15 which projects laterally as far as the external diameter of the flange 13 is formed on and is penetrated parallel to the surface of the flange 13 by two metallic flat plugs 16, 17. The flat plugs 16, 17 have essentially rectangular cross-sectional faces. The top fitting 15 divides the flat plugs 16, 17 on the one hand into plug plugs 18, 19 and on the other hand into wire connecting lugs 21, 22. The wire connecting lugs 21, 22 which are soldered or welded to the respective start or end of the coil wire 14 for example, project somewhat beyond the flange 13.

In the top fitting 15, wire guiding channels 23, 24 which are assigned to the wire connecting lugs 21, 22 and in which the coil wire 14 is guided are formed in the surface running perpendicular to the flange 13. The linear wire guiding channels 23, 24 constitute the shortest connection between the ends of the wire connecting lugs 21, 22 projecting into the top fitting 15 and the coil core 11. Furthermore, the flange 13 has two indents 26, 27 which are directed toward the respective wire guiding channel 23, 24 and open into the wire guiding channels 23, 24. The wire guiding channels 23, 24 are formed in the top fitting 15 in such a way that they extend essentially perpendicular to the flange 13 and parallel to the coil core 11. At least the base of that wire guiding channel of the two wire guiding channels 23, 24 which is assigned to the first layer of coil wire on the coil core 11, i.e. the start of the winding on the coil core 11, is constructed as a channel down to the underside of the flange 13. The wire guiding channels 23, 24 each have side walls 28, 29 whose height is selected such that the coil wire 14 dips at least completely into the wire guiding channels 23, 24.

The wire guiding channels 23, 24 end laterally directly next to the wire connecting lugs 21, 22 which have punch-outs 30 at these points. In the region of the punch-outs 30, semicylindrical winding guides 31, 32 are arranged over the wire connecting lugs 21, 22, the said winding guides 31, 32 being formed on the top fitting 15 and ensuring a junction with a low stress concentration, for the coil wire 14, between the wire guiding channels 23, 24 and the wire connecting lugs 21, 22. In addition, semicircular wire guiding flanges 33, 34 which prevent the coil wire 14 from slipping off the winding guides 31, 32 are formed on the winding guides 31, 32 on the side opposite the top fitting 15.

The coil former 10 is encapsulated by injection molding with plastic at least in the area of the coil core 11 and on the side of the top fitting 15 facing the wire connecting lugs 21, 22. For this purpose, the wrapped coil former 10 is inserted into a sheath-shaped flux concentrating element 35 in a correspondingly designed mold and encapsulated by injection molding as an assembly. The mold is designed in such a way that a largely pot-shaped housing 37 which encloses the flux concentrating element 35, and thus the coil former 10 is formed by the encapsulation by injection molding. Since the flux concentrating element 35 has holes 36 at the level of the coil core 11, the intermediate spaces between the coil windings and the insides of the flux concentrating element 35 has holes 36 at the level of the coil core 11, the intermediate spaces between the coil windings and the insides of the flux concentrating element 35 are also filled with plastic. The housing 37 has in its upper area three circular segment-shaped formed-on elements 38 to 40 which extends as far as the level of the top fitting 15. The formed-on elements 38 to 40 are designed in such a way that the coil former 10 has two free spaces 41*a*, 41*b*, which are connected to one another, above the flange 13 in the area of the plug plugs 18, 19. Furthermore, in each case one recess 42, 43 is formed between the formed-on elements 38 and 39 or 39 and 40. These recesses 42, 43 are obtained during the encapsulation by injection molding by means of corresponding formed-on elements in the mold. The recesses 42, 43 serve to ensure that no plastic melt passes on a direct path into the wire guiding channels 23, 24 during the injection process, the liquid plastic being injected into the mold in the area of the formed-on elements 38 and 40. Instead, the plastic melt fills the wire guiding channels 23, 24 upwards from below, that is to say the plastic melt rises in the wire guiding channels 23, 24 in the axial direction and at the same time stresses the coil wire 14 exclusively in the longitudinal direction, which leads to the smallest possible thermal expansion as a result of the longitudinal orientation of the molecules. As a result of the winding guides 31, 32 formed in the area of the punch-outs 30, tensile stresses in the coil wire 1 caused by the movement of the plastic melt only have a small effect so that the risk of damage to the coil wire 14 is low. The flow of the plastic melt is therefore guided by the specific shape of the housing 37 with the formed-on elements 38 and 40 in a selective way in the longitudinal direction of the wire guiding channels 2, 24 so that the advantage of the linear coil wire guidance in the wire guiding channels 23, 24 is amplified. Since the plastic melt not only fills the wire guiding channels 23, 24 but in addition fills the area between the top fitting 15 as far as the external diameter of the housing 37, the wire guiding channels 23, 24 provide the additional advantage that the plastic melt which has not yet plasticized can shear off above the wire guiding channels 23, 24. This is particularly important during the so-called after-pressure phase of the injection molding process when the reduction in volume of the injection molded encapsulation is compensated. In this phase, high stresses may occur in the coil wire 14 which has been encapsulated by injection molding as a result of the continued movement of the plastic melt which is low in viscosity. However, this movement no longer has an effect, in particular perpendicular to the coil wire 14, since the plastic melt can shear off above the wire guiding channels 23, 24.

Figure 3:
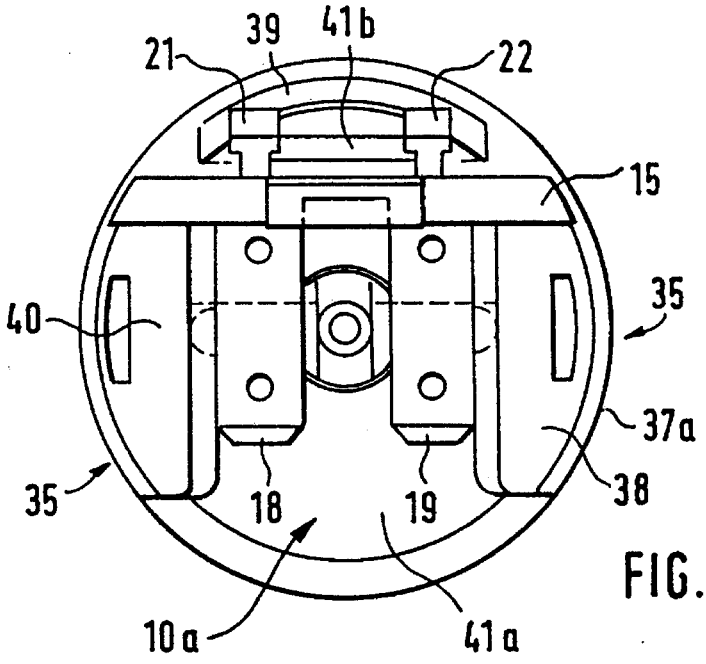
FIG. 3 shows a modified form of a second coil former with injection-molded encapsulation in a plan view.

In a second exemplary embodiment (FIG. 3), instead of being achieved by the recesses 42, 43 during the encapsulation by injection molding of the coil former 10*a* the selective guidance of the plastic melt as described above is achieved by the top fitting 15*a* being extended laterally beyond the flange 13 to the extent that the latter virtually corresponds to the width of the housing 37*a* at the corresponding point. In this case the housing 37*a* does not have any recesses 42, 43. By virtue of the modified design of the top fitting 15*a* it is ensured that the plastic melt impacts against the top fitting 15*a* during injection molding in the area of the formed-on elements 38 and 40, the said fitting 15*a* therefore constituting an obstacle for the plastic melt in the direction of the wire guiding channels 23, 24. In this case also, the plastic melt will therefore fill up the coil former 10*a*, and thus also the wire guiding channels 23, 24, upwardly from below in the axial direction, and thus in the direction of the coil wire, following the path of the smallest flowing resistance. The invention is not only limited to the application in a solenoid valve described above. Instead, applications in the area of coil formers which are encapsulated by injection molding, for example in the case of speed-of-revolution sensors, relays or injection vales, are also conceivable. An essential feature of the invention is that the wire guiding channels 23, 24, and thus the laying of the coil wire 14, are configured in such a way that during the encapsulation by injection molding of the coil former 10, 10*a* the plastic melt only stresses the coil wire 14 in its longitudinal direction and is thus oriented in such a way that the smallest possible thermal expansion results. Furthermore, this longitudinal stressing of the coil wire 14 should be attenuated by suitable measures, by means of the winding guides 31, 32 in the exemplary embodiments. It is particularly advantageous if the housing 37 formed by the plastic melt can be configured in such a way that it permits a selective guidance of the plastic melt.

It will be understood that each of the elements described above, or two or more together, may also find a useful application in other types of methods and constructions differing from the types described above.

While the invention has been illustrated and described as embodied in a coil former with injection-molded encapsulation and method for manufacturing it, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed and desired to be protected by Letters Patent is set forth in the appended claims:

1. A coil former with injection-molded encapsulation, comprising a coil core having a substantially vertical axis; at least one layer of a coil wire wound around said coil core; a flange connected with said coil core; a top fitting arranged above said coil core on said flange and having connection plugs which are connected to said coil wire in an electrically conductive way; groove-shaped coil wire guides formed between said connection plugs and said coil core, said coil wire guides being formed linearly in said top fitting and extending substantially perpendicular to said flange and in an axial direction of said coil core; a housing surrounding said coil core with said flange and said fitting and being composed of plastic material; and semicylindrical winding guides assigned to said connection plugs and arranged as extensions of said coil wire guides above said connection plugs.

2. A coil former as defined in claim 1, wherein said housing has recesses extending to a side of said connection plugs.

3. A coil former as defined in claim 1, wherein said housing has an external diameter, said top fitting projecting as far as said external diameter of said housing.

4. A coil former as defined in claim 1, wherein said plastic material of which said housing is composed, fills said core wire guides in their axial direction.

* * * * *